US006865349B2

(12) United States Patent
Silence et al.

(10) Patent No.: US 6,865,349 B2
(45) Date of Patent: Mar. 8, 2005

(54) MACHINE POST-LAUNCH PROCESS OPTIMIZATION THROUGH WIRELESS CONNECTED CUSTOMER REPLACEABLE UNIT MEMORY

(75) Inventors: Scott M. Silence, Fairport, NY (US); Jane M. Kanehl, Bloomfield, NY (US); Douglas A. Kreckel, Webster, NY (US); Charles H. Tabb, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/403,322

(22) Filed: Mar. 28, 2003

(65) Prior Publication Data

US 2003/0215245 A1 Nov. 20, 2003

Related U.S. Application Data

(63) Continuation-in-part of application No. 10/151,123, filed on May 17, 2002, now abandoned.

(51) Int. Cl.[7] ..... G03G 15/00

(52) U.S. Cl. ..... 399/8; 399/12; 399/24; 399/25

(58) Field of Search ..... 399/8, 12, 13, 399/24–27, 111

(56) References Cited

U.S. PATENT DOCUMENTS

| | | | | |
|---|---|---|---|---|
| 4,496,237 | A | 1/1985 | Schron | |
| 4,827,308 | A | 5/1989 | Howard et al. | |
| 4,961,088 | A | 10/1990 | Gilliland et al. | |
| 5,272,503 | A | 12/1993 | LeSueur et al. | |
| 5,675,534 | A | 10/1997 | Hewitt et al. | 365/185.04 |
| 5,699,091 | A | 12/1997 | Bullock et al. | 347/19 |
| 5,835,817 | A | 11/1998 | Bullock et al. | 399/25 |
| 5,930,553 | A | 7/1999 | Hirst et al. | 399/8 |
| 6,016,409 | A | 1/2000 | Beard et al. | 399/33 |
| 6,019,449 | A | 2/2000 | Bullock et al. | 347/14 |

(List continued on next page.)

OTHER PUBLICATIONS

Charles H. Tabb et al., entitled "Post–Launch Process Optimization of Replaceable Sub–Assembly Utilization Through Customer Replaceable Unit Memory Programming", U.S. Appl. No. 10/151,121 filed May 17, 2002.

(List continued on next page.)

*Primary Examiner*—William J. Royer
(74) *Attorney, Agent, or Firm*—Christopher D. Wait

(57) ABSTRACT

The present invention relates to utilizing memory provided in a machine replaceable sub-assembly to be a medium of distribution for software code updates to that machine relating as to how that machine should operate. In one alternative, there is provided a method for operating a machine employing the steps of providing a replaceable sub-assembly separable from the machine, the replaceable sub-assembly further comprising a wireless interface and a memory in which is stored software code of executable instructions. The method further provides communicating via the wireless interface with the replaceable sub-assembly to store software code of executable instructions relating to the operation of the machine into the memory. The method then provides placing the replaceable sub-assembly into the machine, reading the memory, placing the stored software code of executable instructions into the machine as new machine software code, and then operating the machine in accordance with the new software code. In this way, the replaceable sub-assembly becomes the medium for the machine's software updates.

20 Claims, 6 Drawing Sheets

U.S. PATENT DOCUMENTS

| | | | | |
|---|---|---|---|---|
| 6,113,208 | A | 9/2000 | Benjamin et al. | 347/7 |
| 6,312,106 | B1 | 11/2001 | Walker | 347/50 |
| 6,351,621 | B1 | 2/2002 | Richards et al. | 399/111 |
| 6,377,764 | B1 | 4/2002 | Morris-jones | 399/75 |
| 6,459,860 | B1 | 10/2002 | Childers | 399/12 |
| 6,498,905 | B1 | 12/2002 | Tsuruya | 399/12 |
| 6,532,351 | B2 * | 3/2003 | Richards et al. | 399/111 |
| 6,701,107 | B2 * | 3/2004 | Karakama et al. | 399/111 |
| 2002/0140966 | A1 | 10/2002 | Meade, II et al. | 358/1.15 |
| 2002/0163661 | A1 | 11/2002 | Heusinkveld | 358/1.14 |
| 2003/0065773 | A1 | 4/2003 | Aiba et al. | 709/224 |
| 2003/0086245 | A1 | 5/2003 | Wakabayashi et al. | 361/719 |

OTHER PUBLICATIONS

Scott M. Silence et al., entitled "Post–Launch Process Optimization of Replaceable Sub–Assembly Utilization Through Customer Replaceable Unit Memory Programming Provided in an Alternate Replaceable Sub–Assembly", U.S. Appl. No. 10/151,122 filed May 17, 2002.

Scott M. Silence et al., entitled "Machine Post–Launch Process Optimization Through Customer Replaceable Unit Memory Programming", U.S. Appl. No. 10/151,123 filed May 17, 2002.

* cited by examiner

MACHINE POST-LAUNCH PROCESS OPTIMIZATION THROUGH WIRELESS CONNECTED CUSTOMER REPLACEABLE UNIT MEMORY

35 U.S.C. §120 BENEFIT CLAIM

This application is a continuation-in-part of non-provisional parent Application No.: 10/151,123, filed: May 17, 2002 now abandoned.

RELATED CASES

Cross reference is made to the following related applications incorporated by reference herein: U.S. application Ser. No. 10/151,121, entitled "POST-LAUNCH PROCESS OPTIMIZATION OF REPLACEABLE SUB-ASSEMBLY UTILIZATION THROUGH CUSTOMER REPLACEABLE UNIT MEMORY PROGRAMMING" to Charles H. Tabb, Scott M. Silence, Jane M. Kanehl, and Douglas A. Kreckel; U.S. application Ser. No. 10/151,122, entitled "POST-LAUNCH PROCESS OPTIMIZATION OF REPLACEABLE SUB-ASSEMBLY UTILIZATION THROUGH CUSTOMER REPLACEABLE UNIT MEMORY PROGRAMMING PROVIDED IN AN ALTERNATE REPLACEABLE SUB-ASSEMBLY" to Scott M. Silence, Jane M, Kanehl, Douglas A. Kreckel, and Charles H. Tabb; and, U.S. application Ser. No. 10/151,123, entitled "MACHINE POST-LAUNCH PROCESS OPTIMIZATION THROUGH CUSTOMER REPLACEABLE UNIT MEMORY PROGRAMMING" to Scott M. Silence, Jane M. Kanehl, Douglas A. Kreckel, and Charles H. Tabb.

BACKGROUND

The present invention relates generally to the updating of software code. The invention relates more generally to the utilization of commonly replaced system parts. The invention relates more importantly to memory provided in commonly replaced system parts. The invention relates in particular with regards to a Customer Replaceable Unit (CRU) and a Customer Replaceable Unit Monitor (CRUM).

Many machines have replaceable sub-assemblies. Printing machines for example may have a number of replaceable sub-assemblies such as a fuser print cartridge, a toner cartridge, or an automatic document handler. These subassemblies may be arranged as a unit called a cartridge, and if intended for replacement by the customer or machine owner, may be referred to as a CRU. Examples of a CRU may include a printer cartridge, a toner cartridge, or a transfer assembly unit. It may be desirable for a CRU design to vary over the course of time due to manufacturing changes or to solve post launch problems with either: the machine, the CRU, or a CRU and machine interaction. Further, design optimizations may be recognized subsequent to design launch and machine sale, that a relatively simple code update might realize. However, solving these problems, or providing optimization updates, generally requires a field call to accomplish.

In U.S. Pat. No. 4,496,237 to Schron, the invention described discloses a reproduction machine having a non-volatile memory for storing indications of machine consumable usage such as photoreceptor, exposure lamp and developer, and an alphanumeric display for displaying indications of such usage. In operation, a menu of categories of machine components is first scrolled on the alphanumeric display. Scrolling is provided by repetitive actuation of a scrolling switch. Having selected a desired category of components to be monitored by appropriate keyboard entry, the sub-components of the selected category can be scrolled on the display. In this manner, the status of various consumables can be monitored and appropriate instructions displayed for replacement. In another feature, the same information on the alphanumeric display can be remotely transmitted.

In U.S. Pat. No. 4,961,088 to Gilliland et al., there is disclosed a monitor/warranty system for electrostatographic reproducing machines in which replaceable cartridges providing a predetermined number of images are used, each cartridge having an EEPROM programmed with a cartridge identification number that when matched with a cartridge identification number in the machine enables machine operation, a cartridge replacement warning count, and a termination count at which the cartridge is disabled from further use, the EEPROM storing updated counts of the remaining number of images left on the cartridge after each print run.

In U.S. Pat. No. 5,272,503 to LeSueur et al., provides a printing machine, having operating parameters associated therewith, for producing prints. The printing machine includes a controller for controlling the operating parameters and an operator replaceable sub-assembly adapted to serve as a processing station in the printing machine. The operator replaceable sub-assembly includes a memory device, communicating with the controller when the replaceable sub-assembly is coupled with the printing machine, for storing a value which varies as a function of the usage of the replaceable sub-assembly, the controller adjusting a selected one of the operating parameters in accordance with the stored value for maintaining printing quality of the printing machine.

U.S. Pat. No. 6,016,409 to Beard et al., there is disclosed a fuser module, being a fuser subsystem installable in a xerographic printing apparatus, which includes an electronically-readable memory permanently associated therewith. The control system of the printing apparatus reads out codes from the electronically-readable memory at install to obtain parameters for operating the module, such as maximum web use, voltage and temperature requirements, and thermistor calibration parameters.

U.S. Pat. No. 6,351,621 to Richards et al., discloses that in a printer or copier, a removable module, such as a marking material supply module or a marking device module, is provided with a non-volatile memory chip which retains information about the cumulative use of the module and other performance-related data. The non-volatile memory is accessed through a wireless interface, such as an RF loop or IR detector, which is also associated with the module. The memory can be accessed, through wireless means, either by the printer or copier itself or by an external device. The wireless interface can also be used to access a memory which is attached to part which moves within the printer or copier, such as a roller or drum, thus avoiding the use of wire harnesses.

All of the patents indicated above are herein incorporated by reference in their entirety for their teaching.

Therefore, as discussed above, there exists a need for an arrangement and methodology which will solve the problem of providing software code updates without the need for a field service call. Thus, it would be desirable to solve this and other deficiencies and disadvantages as discussed above with an improved methodology for updating machine software code.

The present invention relates to a method for operating a machine comprising the steps of providing a replaceable sub-assembly separable from the machine, the replaceable sub-assembly further comprising a wireless interface, and a memory. Communication is performed via the wireless interface with the replaceable sub-assembly to store software code of executable instructions relating to the operation of the machine into the memory. This is then followed by placing the replaceable sub-assembly into the machine, reading the memory and placing the stored software code upgrade into the machine as new machine software code. The final step being operating the machine with the replaceable sub-assembly in accordance with the new software code.

The present invention relates to a replaceable sub-assembly for use in a machine. The replaceable sub-assembly comprising a memory a wireless interface and upgraded executable machine instructions suitable for directing the machine to operate in an upgraded fashion, where the upgraded executable machine instruction is communicated with the memory via the wireless interface.

In particular, the present invention relates to a method for operating a printer apparatus comprising the step of providing a customer replaceable unit separable from the printer apparatus, the customer replaceable unit further comprising a memory and wireless means, the memory having stored within a software code upgrade of executable instructions relating to upgraded operation of the printer apparatus. The method further comprises communicating via the wireless means the software code upgrade of executable instructions relating to upgraded operation to the printer apparatus.

DESCRIPTION

By providing additional storage in a replaceable unit or cartridge or CRU and taking proper advantage of that storage or storage already extant, various problems associated with post launch optimization and updates may be accommodated.

By expanding the use of the CRUM memory, a machine, if equipped according to the teachings provided herein, may be availed of software updates that while not requiring immediate installation, never-the-less remain eminently desirable. In effect the CRUM or other cartridge memory becomes the media and medium of distribution for new code installation or updates.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
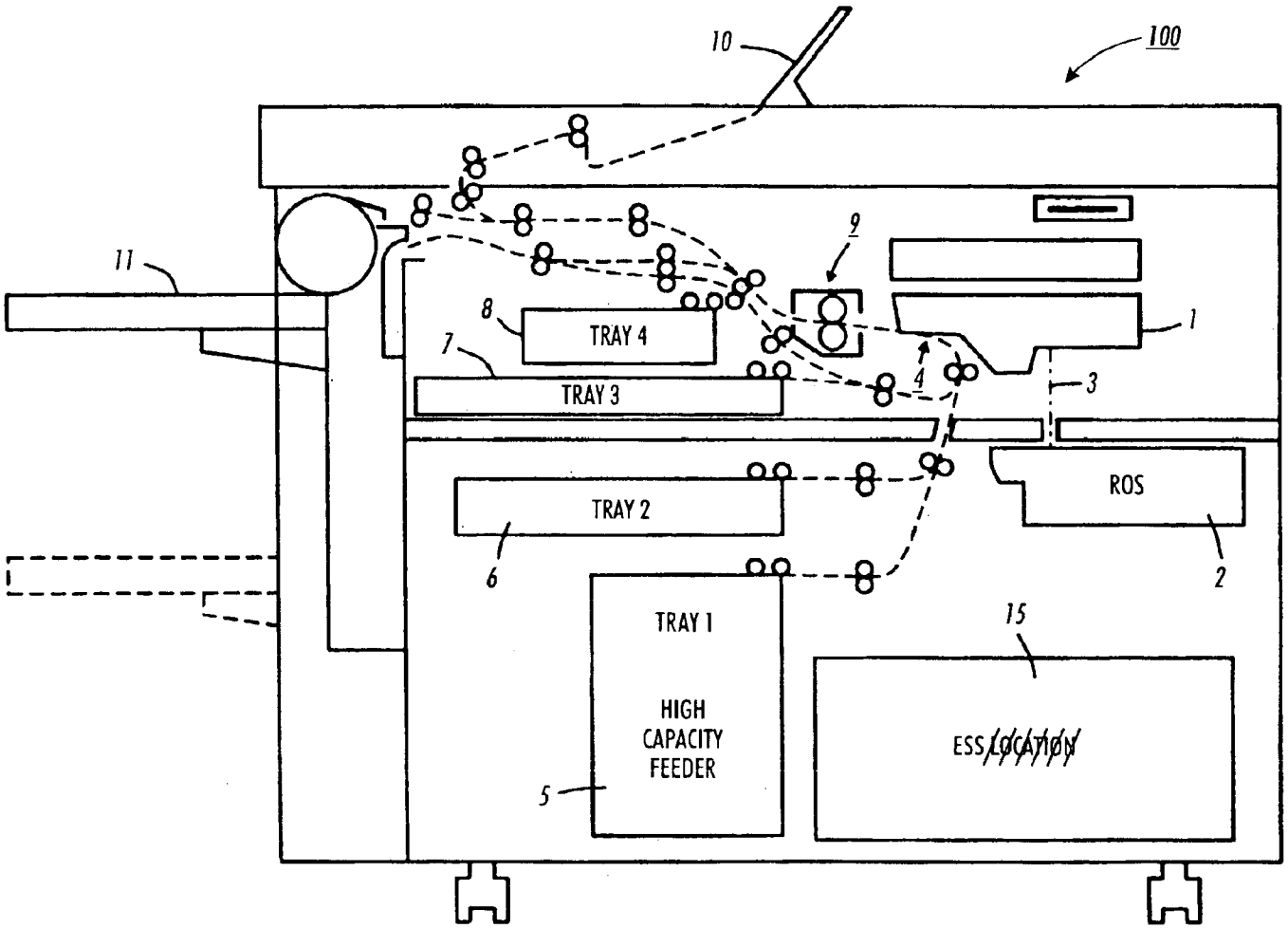
FIG. 1 depicts schematical representation of a printing machine.
Figure 2:
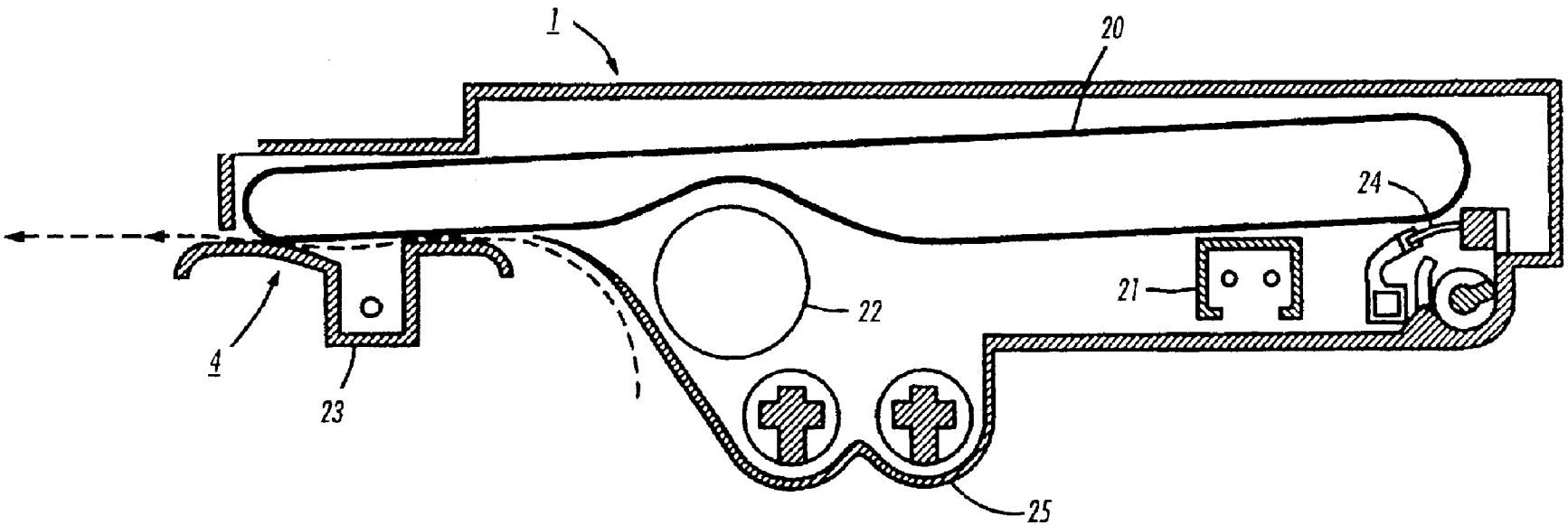
FIG. 2 depicts a cross-sectional view of a replaceable sub-assembly or CRU for the machine of FIG. 1.
Figure 3:
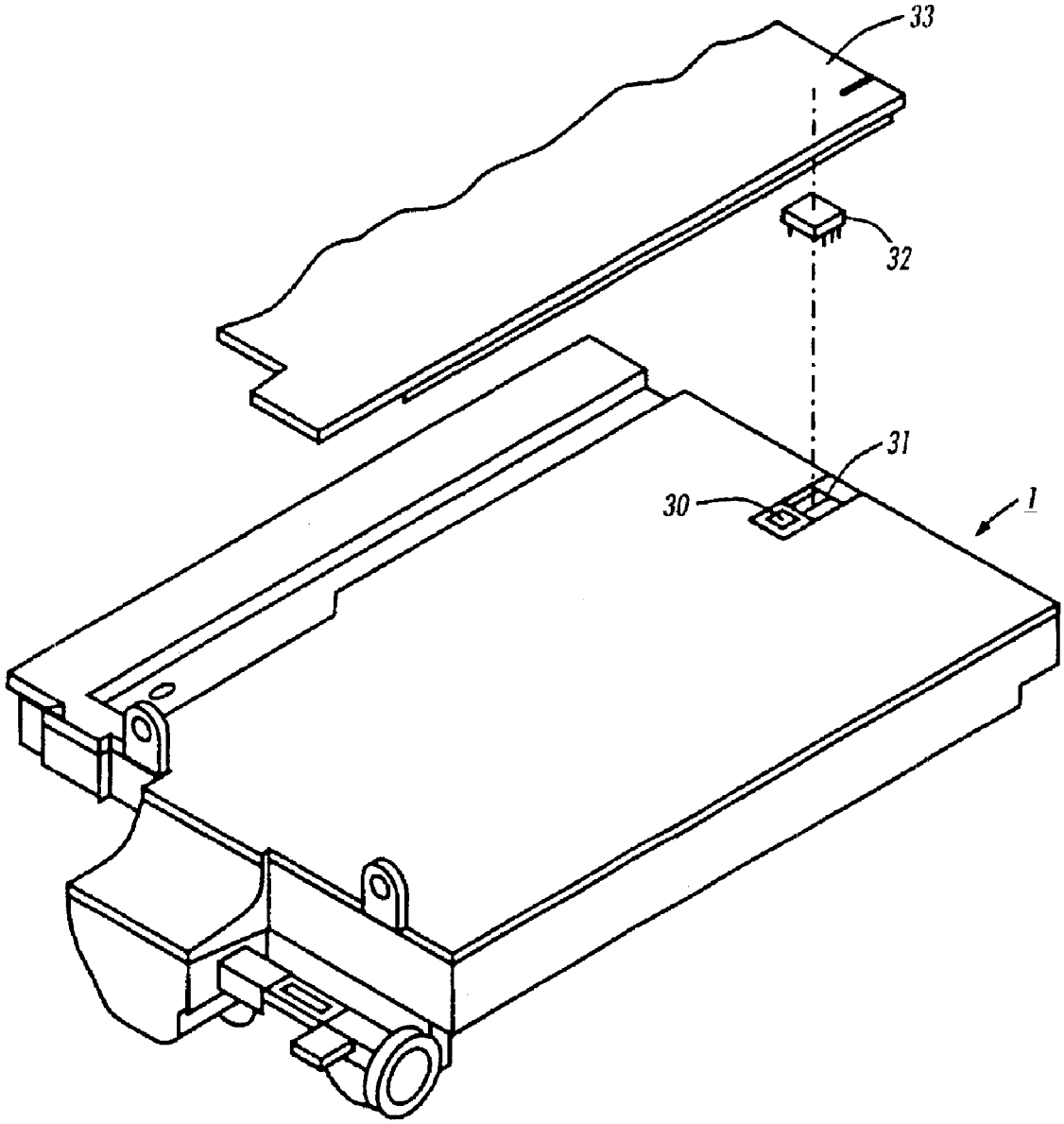
FIG. 3 is a perspective view of the CRU of FIG. 2 in which the connection of the replaceable CRU to the printing machine is shown by way of a partial view.

FIG. 1 shows a printing machine 100, such as a laser printer, employing a replaceable sub-assembly in the form of a xerographic cassette, print cartridge or customer replaceable unit (CRU) 1 which is shown in greater detail in FIGS. 2 and 3. A xerographic imaging member in the form of an endless flexible photoreceptor belt is housed within the CRU 1, together with other xerographic process means as described below. A raster output scanner (ROS) 2 provides an imaging beam 3 which is directed at the photoreceptor belt through an imaging slit in the CRU 1 to form an electrostatic latent image on the photoreceptor belt. The image is developed within the CRU 1 and is transferred, at a transfer station 4, to a copy sheet which is fed to that location from one of four supply trays 5, 6, 7 and 8. The transferred image is fused to the copy sheet at a fusing station 9 and the copy sheet may then be delivered from the machine 100 to be collected either in a sample tray 10 on top of the machine 100 or in a stacking tray 11 on the side of the machine 100. Alternatively, a copy sheet with a fused image on one side only may be put into a tray-less duplex path within the machine 100, to be returned to the transfer station 4 to receive an image on the other side before being delivered from the machine 100 into one of the trays 10, 11.

The raster output scanner 2 incorporates a laser to generate the imaging beam 3, a conventional rotating polygon device to sweep the imaging beam 3 across the surface of the photoreceptor belt, and an acoustic modulator. The imaging beam 3 is modulated in accordance with input signals received from a remote image source, for example, a user interface and keyboard (not shown). The operation of a raster output scanner 2 of that type to generate a latent image on a photoreceptor belt is well understood and need not be described here. The processing of the image signals from the remote source is handled by an electronic sub-system of the machine 100, indicated at 15, while operation of the machine 100 generally is under the control of a machine control unit or CPU (not shown here) which includes one or more microprocessors and suitable memories, for holding the machine 100 operating software.

The CRU 1 may be similar to that described in U.S. Pat. No. 4,827,308. In addition to a photoreceptor belt 20 as depicted in FIG. 2, it includes a charge scorotron 21, a developer device 22, a transfer corotron 23, a cleaning device 24, and developer housing 25. The charge scorotron 21 is located upstream of an imaging slit in the CRU 1 to deposit a uniform electrostatic charge on the surface of the photoreceptor belt 20 before it is exposed to the imaging beam 3. The developer device 22 is located downstream of the imaging slit to bring developer mixture into proximity with, and thereby develop, the electrostatic latent image on the photoreceptor belt 20. The developer mixture is a two-component mixture comprising toner and a magnetically-attractable carrier. Toner is transferred to the photoreceptor belt 20 during image development and replacement toner is dispensed periodically from a hopper (not shown) into the housing of the developer device 22. The transfer corotron 23 is located at photoreceptor belt 20 to the copy sheet which enters the CRU 1 at that point. Finally, the cleaning device 24 removes any residual toner particles from the surface of the photoreceptor belt 20 which is then illuminated by a discharge lamp (not shown) to remove any electrostatic charge remaining on the photoreceptor belt 20.

The CRU 1, as already mentioned, is removable from the machine 100 and can be replaced by another CRU 1 if any of the process elements located therein begin to deteriorate. The CRU 1 has a memory chip 30, as shown in FIG. 3, in the form of an EEPROM (Electrically Erasable Programmable Read Only Memory) mounted in the top cover of the CRU 1. Contact pads 31 are provided on the memory chip 30 so that, when the CRU 1 is inserted into the machine 100, the memory chip 30 is automatically connected to the machine 100 control unit/CPU via a terminal block 32 on a part 33 of the machine 100. When inserted in the machine 100, the memory chip 30 receives information from the printer control unit/CPU. The memory chip 30 is preferably of a non-volatile type of memory such as the EEPROM discussed above. It will be well understood that there are many different ways to effect non-volatile memory and all those ways are within the contemplation of the present invention. For example, conventional ROM (Read Only Memory) is typically volatile and will lose the data contents of its cells when power is removed. However, if ROM is provided in combination with a long life battery on the CRU 1 and if the ROM is of sufficiently low power dissipation, the combination may for all practical purposes effect a non-volatile memory as far as the useful life of the CRU 1 is concerned.

Figure 4:
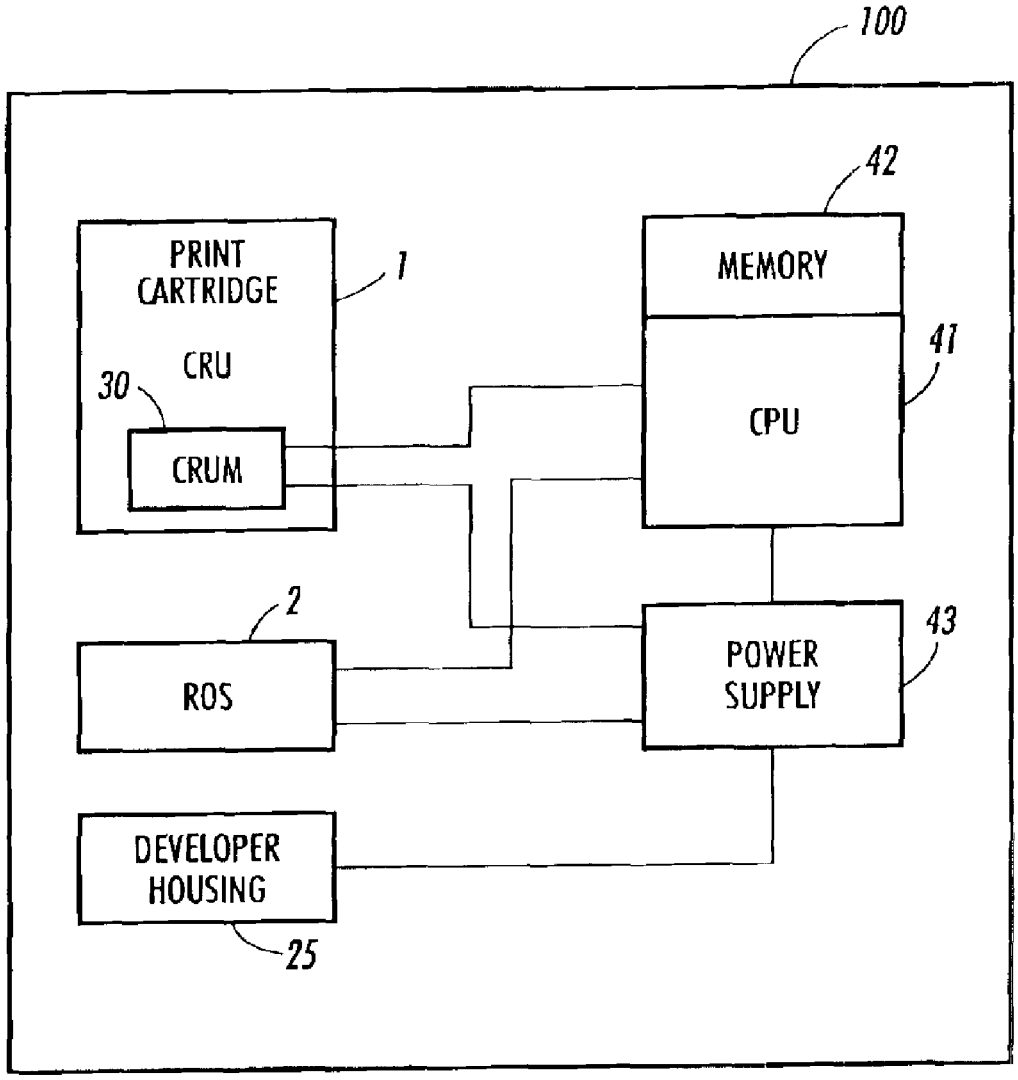
FIG. 4 is a block diagram of the various elements in a machine and their interoperable relationships in fidelity with the teachings of the present invention.

In FIG. 4, there is provided a block diagram of one embodiment which may employ the teachings of the present invention. Machine 100 while a laser printer in this example embodiment may also be a printer/copier or a fax/scanner/printer or any other such variant. Within machine 100 is a CPU 41 which further comprises its own memory 42 either on the same chip-die or locally off-chip. Memory 42 may include bit maps and other stored parameters for use in setpoints utilized within machine 100. At power up subsequent to when power supply 43 is switched on, the boot sequence in memory 42 which CPU 41 invokes, includes instructions to poll any CRU's resident in machine 100. One example CRU 1 as provided here is CRU 1. As CPU 41 polls replaceable units it checks for indication that there are software updates or tags to invoke. There could be lines of software code or other executable instruction to be read in and substituted. Or in one alternative there may just be a tag indicia that different lines of code or lookup tables (LUT) are to be invoked in the operation of the machine 100. The tag could be as simple as the setting of a single bit or it could be an address pointing to the location of data, lines of code/executable instructions, or a LUT with lines of code/executable instructions. In all of these possible scenarios above and which follow below the indicator is one which is shipped with the CRU 1 at time of manufacture or point of distribution.

The CPU 41 may also be provided with code which continually polls for the swapping of a CRU 1. In an alterative obvious to one skilled in the art, the CPU 41 may respond instead to an interrupt from the swapping of a CRU 1. In either case upon determination of swapped or new CRU 1 the CPU 41 shall poll the CRU 1 and its CRUM 30 for indication that there are software updates of executable instructions or new setpoints to invoke.

One example is the situation where a design or manufacturing upgrade to a CRU 1 is made post machine launch to improve photoreceptor aging characteristics. It is desired that machine 100 changes xerographic setpoints as a function of photoreceptor belt cyclic age by way of executable instructions invoking an algorithm operational in CPU 41. For this embodiment there are a number of equations provided as algorithmic software code or executable instructions as well as parameter arguments or settings distributed in the CRUM 30 as a software upgrade. This code of executable instructions and argument set are loaded into and made resident in the machine stored software for operation in CPU 41. These equations are utilized to calculate the CRU charge voltage, the developer housing bias voltage and the ROS imaging exposure level as a function of photoreceptor belt age in cycles of machine temperature and machine humidity. These equations as manifest in upgraded executable instruction code contain a number of numerical constants which are tied to the photoreceptor belt aging rate, temperature and humidity. One example embodiment of such interaction of setpoints and algorithm is found in the operation of the following equation for the ROS exposure:

$$\text{Exposure}=A\times\text{temperature}+B\times\text{Humidity}+C\times\text{number of photoreceptor cycles.}+D.$$

In order to implement a manufacturing change which impacts the aging rate, it would be required to make a change to parameter C. If the photosensitivity to temperature or humidity changes, then the A or B setpoints would change. If the overall photosensitivity changed, then D would need to change.

It is necessary to change the machine system software to accommodate these changes. For machines already in the field this may be normally be too prohibitive in cost. With this invention the numerical constants (A,B,C,D) are stored in the CRU 1 CRUM 30 along with the code for the equation above and are read by the machine 100 as software as invoked by CPU 41. So if any material or mechanical upgrade is made to the print cartridge which improves the aging rate, then the constants stored in the CRUM 30 bit map would also be changed on the manufacturing line to reflect this change. To enable the teaching provided herein of this invention, the machine software for CPU 41 is written as discussed above to read the particular sections of the CRUM 30 which hold the algorithm constants and the algorithm code as upgraded executable software code. Also the machine software is written to use the correct bit map information in its algorithms to update the particular look up tables which are used to set the required power supply voltages or currents, and which are used to set the ROS exposure within the machine 100. When the upgraded CRU 1 is installed into the machine 100, the machine 100 will read the CRUM 30 bit map and automatically upgrade the requisite numbers within its look up tables which will then be used to change the requisite voltages, currents, and exposure when the machine 100 is running in order to take advantage of the new photoreceptor belt changed aging rate.

This invention can also be used to change machine setup and aging algorithms to solve problems post-launch which may or may not be related to the particular CRU 1 which contains the CRUM 30. For example, a toner cartridge CRUM may provide the above described software code updates for the operation of a CRU 1. This is quite desirable as toner cartridges are typically replaced much more often than CRU's 1. Other desirable candidates would include filler bottles and waste bottles provided with a CRUM. Thus, a post-launch software update or upgrade can be resident in a machine 100 at a much earlier time than if it was distributed by a less often replaced CRU 1.

Indeed, in one embodiment the software which is installed from the CRUM 30 to the CPU 41 and its memory 42 has nothing to do with the medium of distribution i.e. the CRU 1. Instead the software update/upgrade is to enhance the operation of the native operating system, be it for a bug fix or an improved feature set. In one example, it may be an upgrade to the graphic user interface (GUI) so as to allow new menu items, hierarchically reorder menu items or improve "look and feel". It may be simply a personalized work environment optimized for a particular machine customer.

The software upgrade may provide improvements to the color rendition capability of the machine 100 (for machines running process color, that is, CMYK toners). In one embodiment, this is accomplished via updates to the Color Rendition Dictionary (CRD) stored in the Digital Front End (DFE) of the machine 100. The CRD is essentially a large LUT for mappings color images into the specific CMYK space used by a xerographic engine. The CRUM could deliver adjustments to the CRD or an entirely new CRD to the machine 100. Alternately, improvements to the color rendition capability of the machine 100 could be accomplished through updates to the profiles used by specific applications that generate the images for printing. These ICC profiles are resident on the computers that feed images to the DFE. In this case, the computer or operator would normally need to pole the DFE for the update. However the flag for poling the DFE could instead be turned on by the executable instructions loaded into the machine 100 from the CRUM 30.

Improvements to the image rendition capability of the machine 100 can also be delivered via the CRUM 30. For instance, improvements in the dot patterning structures which the printer uses to eliminate image quality defects such as Moiré patterns or half-tone mottle may be distributed by a CRU 1. An example of a simple modification which could be delivered through the CRUM 30 is swapping the do patterns used by 2 colors to optimize the overall half-tone image quality.

As discussed above, changes to process controls algorithms or xerographic setpoints in the machine 100 may be delivered via the CRUM 30. Further, specific examples comprise adjustments to the setpoints which control the shape of the Toner Reproduction Curve (TRC). These setpoints changes may be changes in a ROS exposure, ETAC (Enhanced Toner Area Coverage) sensor output target, or a change in the voltage level in any of a number of electrostatic actuators. Another example embodiment is adjustment to fuser subsystem setpoints such as fuser roll temperature or dwell time (adjusted via fuser roll speed). The variations achievable are, as will be understood by those skilled in the art, limited only by the storage size of the CRUM 30 or other CRU memory, and the operational boundaries and feature set of the machine 100.

Figure 5:
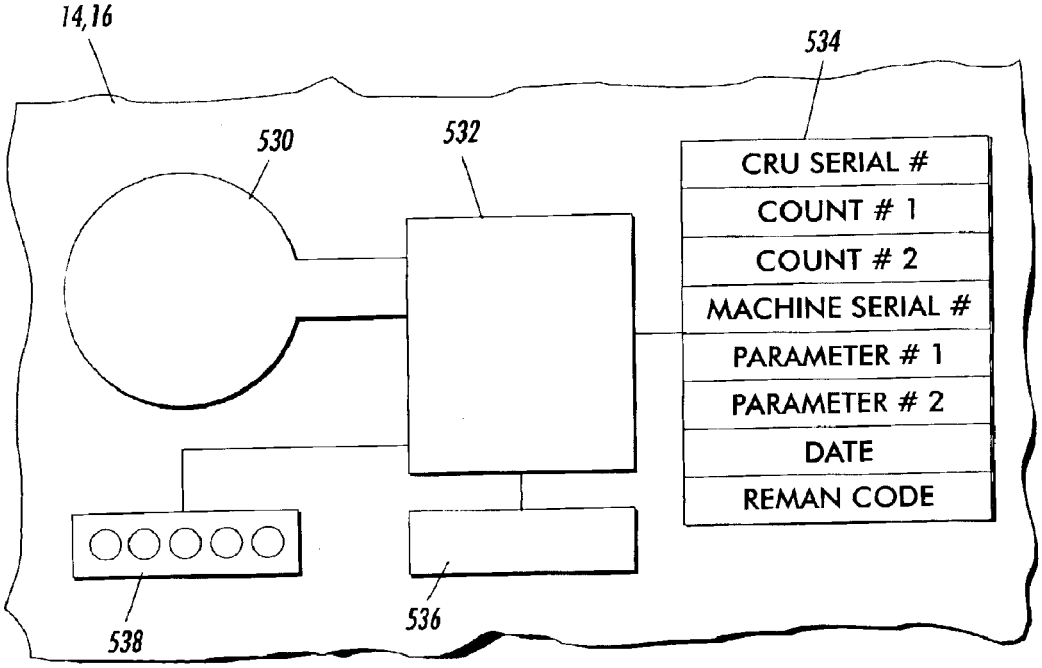
FIG. 5 is a simplified view showing the essential elements of a wireless monitoring and control device associated with a replaceable module.

FIG. 5 is a simplified view showing the essential elements of a CRUM 30 which is operable through wireless means, according to the present invention. The CRUM 30 is preferably permanently attached to a surface either on the outside or the inside of a particular module, such as a marking material supply module 14 or marking device module 16; a portion of such a surface is shown in FIG. 5. In order to operate through wireless means, a CRUM 30 requires some sort of wireless interface, such as the RF loop indicated as 530 in FIG. 5 (along with, of course, associated circuitry, the nature of which would be apparent to one of skill in the art), although other wireless interfaces, such as an infrared detector, ultrasound detector, or some other optical coupling, could be provided.

In the particular illustrated embodiment, the RF loop 530, which is sensitive to RF signals of a predetermined frequency, is associated with a chip 532. According to a preferred embodiment of the invention, this chip 532 includes circuitry which acts as an interface between the RF loop 530 and non-volatile memory 534. (Of course, in a practical embodiment, the non-volatile memory 534 could be disposed within the chip 532, but is here shown separately for purposes of clarity. In one possible embodiment, the RF loop 530 can be formed as an etched loop aerial as part of the circuit board forming the CRUM 30. Chip 532 may also have associated therewith a power supply 536, the exact nature of which will depend on a specific design.) In order to act as such an interface, chip 532 includes circuitry for recognizing and processing wireless signals of a particular type which may be detected on RF loop 530. The chip 532 may further be provided with a "hard wire" interface 538, which could be adapted to interact with circuitry within the printer 100.

As can be seen in FIG. 5, the non-volatile memory 534 includes predetermined locations therein for a module serial number, print counts (for the cumulative use of the module and/or a maximum allowed number of prints to be made with the module), re-manufacturing date and code, as needed, such as according to the descriptions of CRUM functions noted above.

Depending on a particular embodiment of the present invention, the wireless operation of a CRUM 30 associated with the module such as 14 or 16 can work in different ways. In one possible embodiment, the detection of a suitable wireless signal on RF loop 530 by chip 532 causes the chip 532 to read out all data relating to the CRUM 30 which are stored in non-volatile memory 534 at any given time. This data from memory 534 can either be broadcast back through RF loop 530 by wireless means (if such a transmission means is provided, such as within chip 532) or alternately, can be read out through hard wire interface 538 to, for example, CPU 41. In turn, this information can be a sent from CPU 41 to a user interface and/or sent to a computer over a local area network.

Another type of wireless operation of a CRUM 30 is to have an initially detected wireless signal cause chip 532 to make memory 534 to enter a "write mode." In other words, the initial wireless contact, such as a wireless signal of a predetermined type, which activates the chip 532 while causing the chip 532 to expect another wireless data stream through RF loop 530 within a predetermined time frame. This incoming wireless data can then be used to populate specific locations in the memory 534, such as to reset different performance data parameters within the memory 534. Most specifically, an initial wireless signal could be used to reset the various print counts in the memory to go back to zero or to some other predetermined number. This function would be useful for a re-manufacturing process in which the remanufactured module can once again be used to output a predetermined number of prints. Alternately, wireless means can be used to change or otherwise update other performance data in the memory 534, such as changing parameters for optimal pulse width or transfer efficiency, in view of testing on the module which was performed as part of the re-manufacturing process. Finally, there could also be entered into memory 534 data relating to the date of remanufacture, as well as a special codes relating to what type of actions were taken on the module in the remanufacture process, for instance, whether or not a photoreceptor belt was replaced or whether a particular ink tank was refilled.

If wireless means are used to change data in memory 534, it may be desirable to recognize that certain data within the memory 534 associated with a particular model should never be changed. For instance, it may be important that the serial number or master print count of the module never be changed, the matter how often the module is remanufactured. Alternately, if some specific re-manufacturing actions are taken on a module, it may be necessary to change only one of the parameters in memory 534 while leaving the various print counts intact. In such cases, it may be desirable to provide a system in which a special "leave unchanged" code is read into a particular location in memory 534, this special code being interpreted by chip 532 as an instruction to leave whatever data is in that particular location in memory 534 unchanged.

Depending on certain considerations, such as cost, or the fact that a CRUM system is being retrofit into an existing model of machine 100, certain data can go in or out of the CRUM 30 through RF loop 530 or alternately through hard wire interface 538. For example, the wireless operation of the various CRUMs may be on a very simple level, such that the detection of a suitable wireless signal on RF loop 530 can simply "unlock" the non-volatile memory 534 for writing therein, although the actual writing to memory 534 may take place through hard wire interface 538. In terms of enabling the present invention, basic principles of wireless controls of electromechanical and electronic devices, such as garage doors and televisions, are well known. The general principles of operating a CRUM 30 are readily adapted from these arts in view of the present specification. As described in U.S. Pat. No. 5,675,534 incorporated by reference herein in its entirety for its teaching, it is generally known in the art to provide certain sophisticated security devices, such as involving code hopping encryption, to prevent unauthorized wireless access to the CRUM 30. As shown in FIG. 5, the chip 532 may have provided therein an encryption key which will have the effect of permitting only those users having the encryption key to access the CRUM 30 by wireless means. This feature is very useful for preventing unauthorized tampering with data in memory 534, such as to alter the print counts. While the use of systems such as code hopping encryption are known in the "security" context of locking automobiles and a garage door openers, it is believed to be novel to use this system in the context of preventing access to memory associated with replaceable modules in office equipment.

Figure 6:
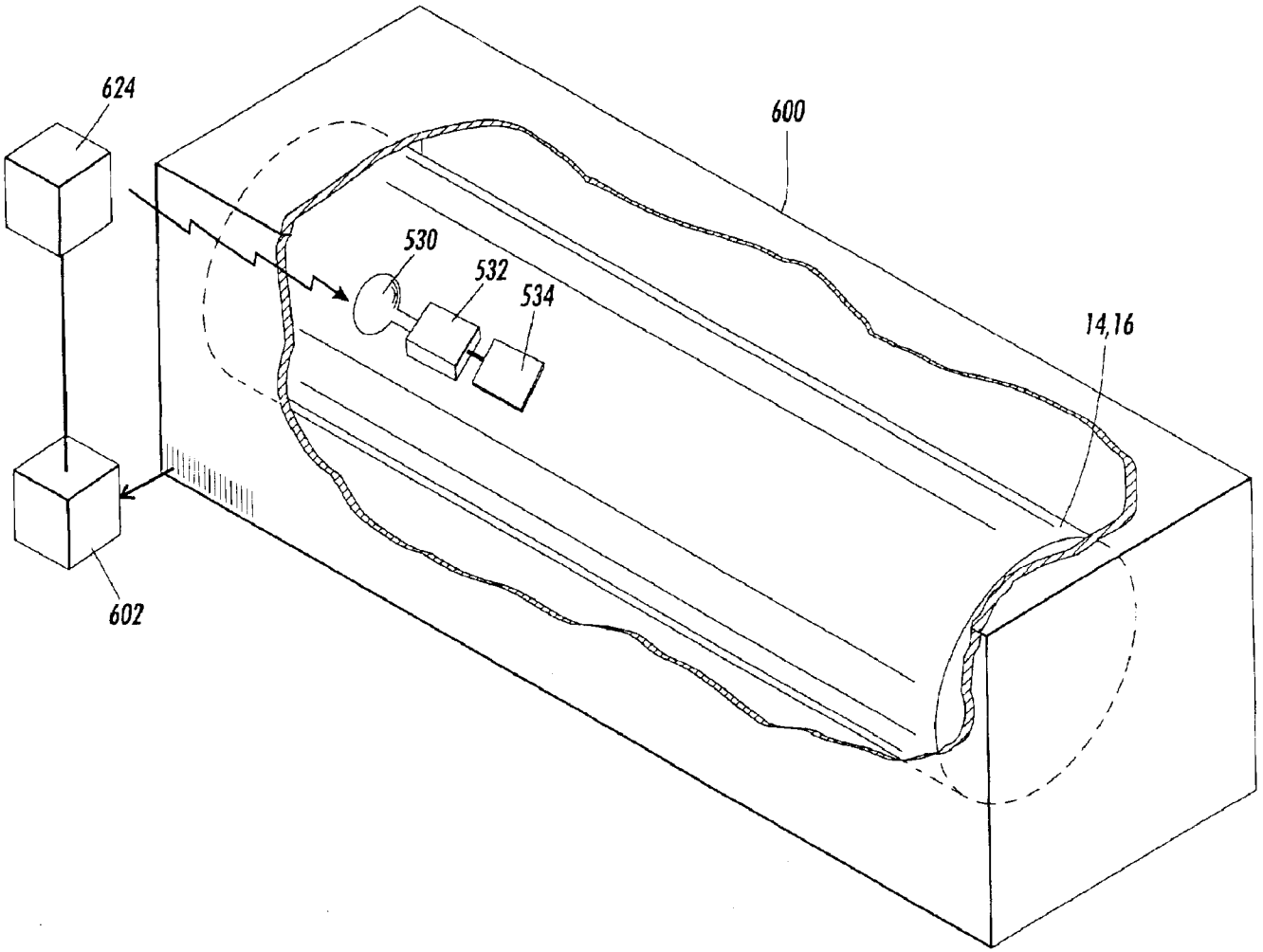
FIG. 6 is a simplified view showing a replaceable module disposed within a package and being processed within a system.

In addition to facilitating the reading and writing of data from a memory 534 associated with the CRUM 30, the present invention facilitates new techniques in both re-manufacturing and distributing replaceable modules such as marking material module 14 and marking device module 16. One key advantage of wireless communication with a CRUM 30, particularly Infrared or RF communication, is that in the wireless signals can pass through many types of packaging, and thus a CRUM 30 can be operated even while the module to which they are associated is packaged. FIG. 6 is a simplified view showing how a module such as 14 or 16 disposed within a signal-transmissive (for instance, cardboard) package 600 can be accessed and operated by wireless means. A device 624, which emits the suitable RF or infrared radiation, can be used to write relevant data into memory 534 of the CRUM 30. Such data may be of a time sensitive variety, such as the date a particular package module is mailed to an end user: in such a case, at may be desirable to have the module itself prepackaged and write the date of mailing to memory 534 just as the package 600 is going out the door. Similarly, special codes can be read into memory 534 representing, for example, the identity of the end user intended to receive the module in the mail, or a particular service contract number under which the packaged module is sent. Because of the wireless nature of writing into memory 534, a supply of modules, already in packages 600, can be retained in a warehouse and written into with relevant information only as the are sent to end users.

Another possibility is to package different modules 14, 16, and have a bar code reader, such as 602, or equivalent device, read markings on the package 600, and then cause a device 624 to write data relating to the bar code data into memory 534 by wireless means. For example, the bar code reader 602 could read a bar code on the outer surface of package 600 representative of the addressee of the package 600, and cause device 624 to write a code identifying the address into memory 534.

Alternately, as the CRUM 30 is capable of broadcasting back information and memory 534 by wireless means as well, the particular CRUM 30 within package 600 could be queried by wireless means just as it is being sent to a user, and this information recorded, so that a vendor could know exactly which CRUMs, identified by serial number, were sent to what addressee on any particular day. Another possibility is to determine the serial number of a module within a package 600 by wireless means, and then have a bar code writer print a code relating to the serial number on a label to be attached to the package 600. Another feature enabled by the use of wireless communication would be the use of one transmitter/receiver within the machine 100 being able to communicate with multiple modules used within the machine 100. This would provide a cost saving, as multiple harnesses for each device would not be needed.

In closing, by employing the CRUM 30 or other CRU memory as the media and the distribution of replaceable cartridges or customer replaceable units (CRU) 1 as a medium of software distribution, software updates/upgrades may be readily distributed from the factory or other central point of distribution post-launch of the target machine without the need for a field service call. Employing wireless communication with the CRUM 30 allows those software updates to be made as the package 600 is being shipped out the door thus insuring the most up to date code is resident therein. Thereby, application of this methodology will allow appropriate software replacement schedules to be instituted for updates/upgrades which minimize both cost and customer down time.

While the embodiments disclosed herein are preferred, it will be appreciated from this teaching that various alternative modifications, variations or improvements therein may be made by those skilled in the art. For example, it will be understood by those skilled in the art that the teachings provided herein may be applicable to many types of machines and systems employing CRU's, including copiers, printers and multifunction scan/print/copy/fax machines or other printing apparatus alone or in combination with computer, fax, local area network and internet connection capability. All such variants are intended to be encompassed by the following claims:

What is claimed is:

1. A method for operating a machine comprising the steps of:

providing a replaceable sub-assembly separable from the machine, the replaceable sub-assembly further comprising a wireless interface, and a memory;

communicating via the wireless interface with the replaceable sub-assembly to store software code of executable instructions responsive to a design variance in the customer replaceable unit relating to the operation of the machine into the memory;

placing the replaceable sub-assembly into the machine;

reading the memory and placing the stored software code of executable instructions into the machine as new machine software code; and, operating the machine in accordance with the new software code.

2. The method of claim 1 wherein the machine is a printing apparatus.

3. The method of claim 2 wherein the replaceable sub-assembly is a CRU.

4. The method of claim 3 wherein the memory is a non-volatile type of memory.

5. The method of claim 4 wherein the memory is a CRUM.

6. The method of claim 2 wherein the software code of executable instructions includes parameter arguments.

7. A replaceable sub-assembly for use in a machine comprising:

a memory;

a wireless interface; and, upgraded executable machine instruction suitable for directing the machine to operate in an upgraded fashion responsive to a design variance in the customer replaceable unit, where the upgraded executable machine instruction is communicated with the memory via the wireless interface.

8. The replaceable sub-assembly of claim 7 wherein the replaceable sub-assembly is a CRU.

9. The replaceable sub-assembly of claim 8 wherein the memory is a CRUM.

10. The replaceable sub-assembly of claim 9 wherein the upgraded executable machine instruction includes parameter arguments.

11. The replaceable sub-assembly of claim 9 wherein the upgraded executable machine instruction includes a look-up table.

12. The replaceable sub-assembly of claim 9 wherein the upgraded executable machine instruction includes code to upgrade a GUI.

13. The replaceable sub-assembly of claim 9 wherein the upgraded executable machine instruction provides a software bug fix to the machine.

14. The replaceable sub-assembly of claim 9 wherein the machine is a color printing apparatus.

15. The replaceable sub-assembly of claim 14 wherein the upgraded executable machine instruction includes code to improve the color rendition capability of the color printing apparatus.

16. A method for operating a printer apparatus comprising the step of:

providing a customer replaceable unit separable from the printer apparatus, the customer replaceable unit further comprising a memory and wireless means, the memory having stored within a software code upgrade of executable instructions relating to upgraded operation of the printer apparatus responsive to a design variance in the customer replaceable unit; and, communicating via the wireless means the software code upgrade of executable instructions relating to upgraded operation to the printer apparatus.

17. The method of claim 16 wherein the memory is a CRUM.

18. The method of claim 17 wherein the software code upgrade of executable instructions provides a software bug fix to the printer apparatus operation.

19. The method of claim 17 wherein the software code upgrade of executable instructions includes code to upgrade a GUI.

20. The method of claim 17 wherein the software code upgrade of executable instructions includes code to improve the color rendition capability of the printer apparatus.

* * * * *